United States Patent [19]

Uchiyama

[11] 4,204,452

[45] May 27, 1980

[54] SINGLE KEY PREFERENTIAL SELECTION DEVICE IN ELECTRONIC MUSICAL INSTRUMENT

[75] Inventor: Yasuji Uchiyama, Hamakita, Japan

[73] Assignee: Nippon Gakki Seizo Kabushiki Kaisha, Japan

[21] Appl. No.: 911,710

[22] Filed: Jun. 2, 1978

[30] Foreign Application Priority Data

Jun. 8, 1977 [JP] Japan ..... 52-67593

[51] Int. Cl.[2] ..... G10H 1/00; G10H 5/00

[52] U.S. Cl. ..... 84/1.01; 84/DIG. 2; 328/137; 328/154; 340/147 LP; 340/166 R

[58] Field of Search ..... 84/1.01, DIG. 2, DIG. 20; 340/365 R, 365 A, 366 R, 147 LP; 328/137, 154

[56] References Cited

U.S. PATENT DOCUMENTS

| | | | |
|---|---|---|---|
| 4,012,980 | 3/1977 | Suzuki | 84/1.01 |
| 4,055,103 | 10/1977 | Machanian | 84/1.01 |
| 4,074,233 | 2/1978 | Swain | 340/147 LP |
| 4,100,831 | 7/1978 | Deutsch | 84/1.01 |
| 4,122,744 | 10/1978 | Uetrecht | 84/DIG. 2 |
| 4,138,916 | 2/1979 | Kitagawa | 84/1.01 |
| 4,138,917 | 2/1979 | Sakashita et al. | 84/1.01 |
| 4,141,268 | 2/1979 | Kugisawa | 84/1.01 X |

*Primary Examiner*—S. J. Witkowski

*Attorney, Agent, or Firm*—Robert E. Burns; Emmanuel J. Lobato; Bruce L. Adams

[57] ABSTRACT

A monophonic electronic musical instrument comprises a single key preferential selection device. Key switches are connected in a matrix fashion between the group lines and the individual lines. The group lines are sequentially and repetitively scanned to detect the first one in the sequence of the groups where any key switch is closed, and the individual lines to which any closed key is connected deliver key detection signals, which in turn are introduced into a preference circuit to select the key detection signal of the highest priority. The group detection and the individual detection co-operatively designate a single key for tone production.

3 Claims, 9 Drawing Figures

SINGLE KEY PREFERENTIAL SELECTION DEVICE IN ELECTRONIC MUSICAL INSTRUMENT

BACKGROUND OF THE INVENTION

This invention relates to a single key preferential selection device in electronic musical instruments, and more particularly to the provision of a single key preferential selection device operated in a digital mode.

One example of a monophonic electronic musical instrument utilizing a single key preferential selection device is a monophonic music synthesizer as shown in FIG. 1.

The music synthesizer has a voltage controlled oscillator (VCO) 1 as a tone generator. The oscillation frequency thereof is varied in response to a tone pitch voltage KV which is an output from a key section 2 (including key switches and DC voltage sources) in correspondence to the tone pitch of a depressed key, so as to provide a tone source signal having the tone pitch of the depressed key. The output of the oscillator 1 is applied through a voltage controlled filter (VCF) 3 and a voltage controlled amplifier (VCA) 4 to a power amplifier 6 connected to a loudspeaker 5. Thus, the tone source signal is subjected to tone-coloring in the filter 3 and to envelope impartation in the amplifier 4 to provide a musical tone signal which is an output as a performance tone through the loudspeaker 5.

In this operation, control waveform signals ENVF and ENVA provided by control waveform generating circuits (E.G.) 7 and 8 are applied to the filter 3 and the amplifier 4, respectively, as a result of which the tone color and envelope of the musical tone signal are controlled according to the control waveform signals ENVF and ENVA, respectively. The control waveform generating circuits 7 and 8 operate to generate the control wave-form signals ENVF and ENVA the voltage values of which are varied with lapse of time in correspondence to a key-on detection signal which exhibits a step-up during the operation of a key in the key section 2. The shapes of the control waveform signals ENVF and ENVA are determined by control voltages CONF and CONA which are outputs by a control voltage generating circuit 9 operated by the performer.

The key section 2, in general, has a preferential selection circuit, so that even if a plurality of keys are operated, a tone pitch voltage signal KV corresponding to the key having the first priority order is outputed. Thus, the key section 2 has a function of selecting a single key for designating a single tone.

In all of the conventional key sections 2, signals are processed in an analog mode to conduct the preferential selection operation. Accordingly, the conventional key sections are not suitable for forming them in the form of an integrated circuit. Furthermore, for the same reason, miniaturization of the key section and simplification of the process of manufacturing the same are necessarily limited to a certain extent.

SUMMARY OF THE INVENTION

Accordingly, an object of this invention is to eliminate the above-described difficulties accompanying a conventional key section.

More specifically, an object of the invention is to provide a single key preferential selection device in which, as a preferential selection circuit, signals can be processed in a digital mode.

The novel features which are considered characteristic of this invention are set forth in the appended claims. This invention itself, however, as well as other objects and advantages thereof will be best understood by reference to the following detailed description of an illustrative embodiment, when read in conjunction with the accompanying drawings.

DETAILED DESCRIPTION OF THE INVENTION

This invention will be described with reference to its preferred embodiment in which the technical concept of the invention is applied to the key section of a monophonic electronic musical instrument providing four octaves of notes ($C_2$, $C\#_2$-$C_3$, . . . , $C\#_5$-$C_6$) with 49 keys.

Figure 2:
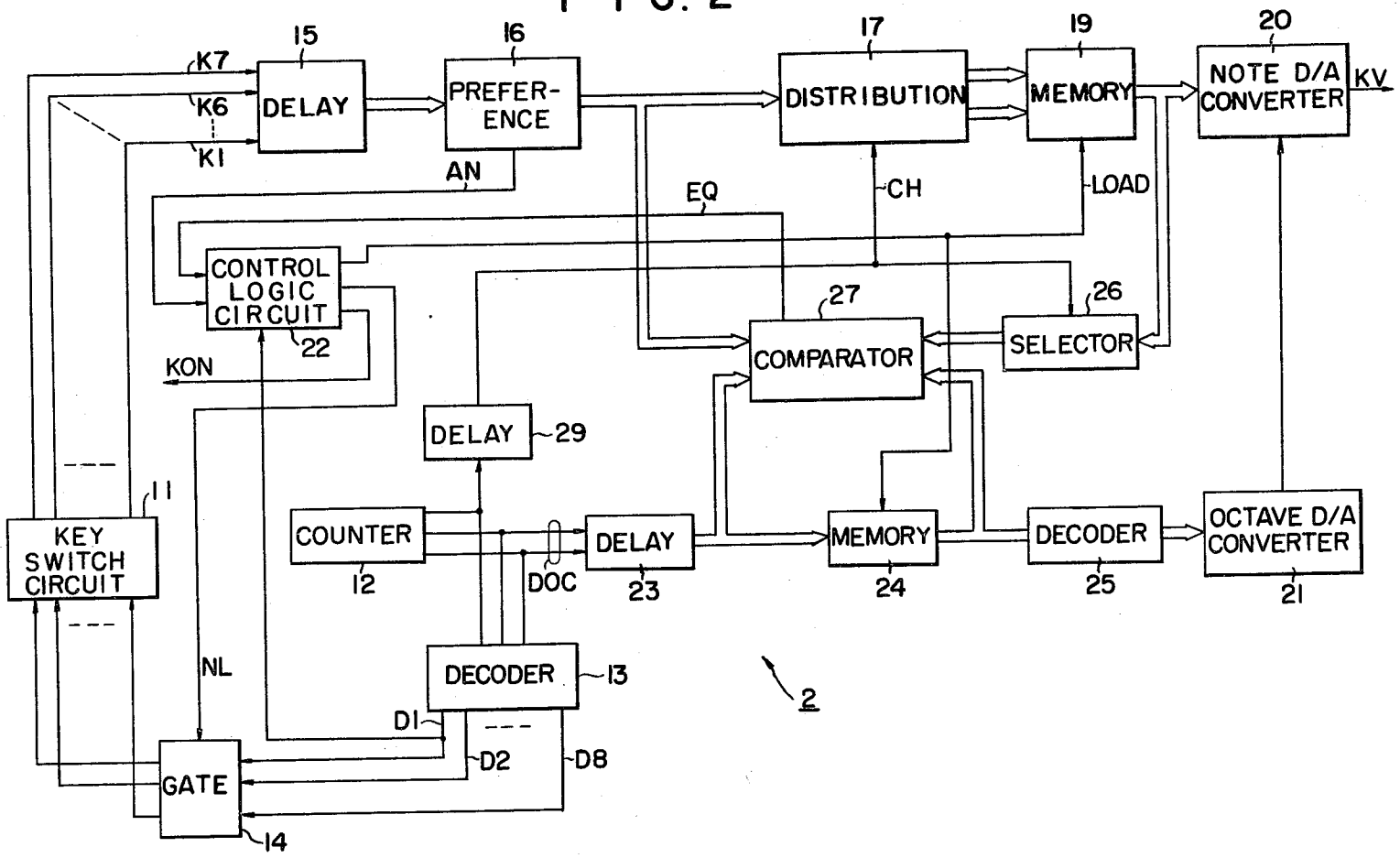
FIG. 2 is also a block diagram showing one example of the single key preferential selection device in the electronic musical instrument according to the invention.
Figure 3:
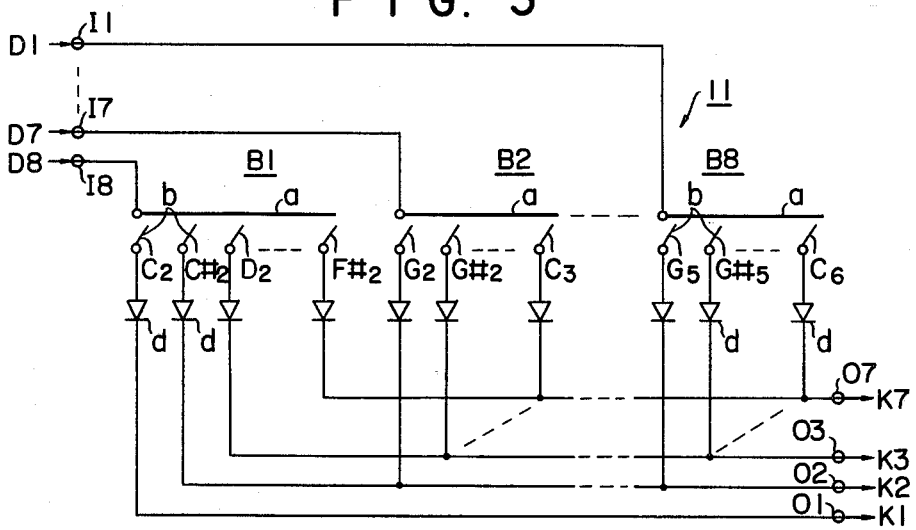
FIG. 3 is a schematic circuit diagram showing a key switch circuit included in FIG. 2.

The key section 2 is shown in FIG. 2 and includes a key switch circuit 11 shown in FIG. 2 and more concretely in FIG. 3. The key switch circuit 11 is provided for four octaves (including plus one), and the key switches are divided into eight key switch groups B1 through B8 each covering a half octave (only B1 covering seven notes). Each of the key switch groups B1 through B8 has a common bus bar a and movable contacts b which are turned on in response to the operations of the respective keys. The first key switch group B1 has seven key switches $C_2$ and $C\#_2$ through $F\#_2$ corresponding to the first half ($C\#_2$-$F\#_2$) of the lowest octave plus one note $C_2$ adjacent thereto. The second key switch group B2 has six key switches $G_2$—$C_3$ corresponding to the second half ($G_2$-$C_3$) of the lowest octave. Similarly, the third key switch group B3 through the eighth key switch group B8 have six key switches $C\#_3$-$F\#_3$, . . . , six key switches $G_5$—$C_6$ corresponding to a half octave ($C\#_3$—$F\#_3$), . . . , a half octave ($G_5$—$C_6$), respectively.

The bus bars a of the eighth key switch group B8 through the first key switch group B1 are connected to scanning signal input terminals I1 through I8, respectively. Respectively corresponding ones of the movable contacts b in the respective groups B1–B8 are connected together in common to respective output terminals 02–07, and the movable contact b of $C_2$ key alone is connected to an independent output terminal 01. Thus the key switches are connected in a matrix fashion between the input terminals (constituting group lines) and the output terminals (constituting individual lines). Thus, when sequential scanning signals D1 through D8 are applied to the input terminals I1 through I8 in the stated order, key detection signals K2–K7 are outputs through blocking diodes d via the key switches (which are for a half octave) in the key switch groups B8–B1. Thus, the key detection signals K2–K7 provided by the eight key switch groups B8–B1 are applied to the output terminals 02–07 which are provided in common for the eight key switch groups.

The first key switch group B1 has the key switch $C_2$ for the note $C_2$ in addition to the key switches $C\#_2$-$F\#_2$ for a half octave, as was described before. Therefore, when the scanning signal D8 is applied to the scanning signal input terminal I8, a key detection signal K1 is solely applied through a blocking diode d to an output terminal 01 while the key detection signals K2–K7 are outputted in the first key switch group B1.

Figure 4:
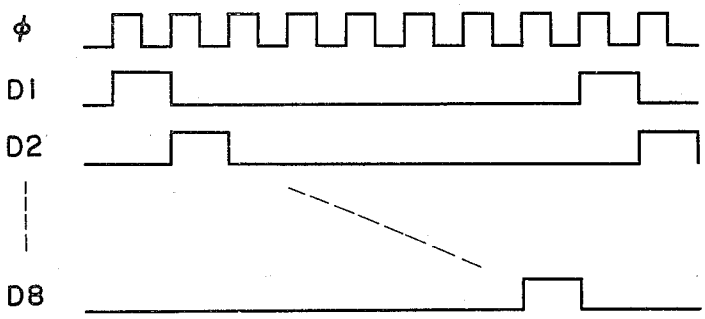
FIG. 4 is a waveform diagram for a description of scanning signals.

The scanning signals D1 through D8 are obtained by converting the outputs of a 3-bit counter 12 (operating to count clock pulses $\phi$(FIG. 4)) into eight sequential pulses D1 through D8 (FIG. 4) by means of a decoder 13. These pulses D1 through D8 are applied through a scanning signal gate circuit 14 (FIG. 2) to the key switch circuit 11. In this connection, when the contents of the 3-bit counter 12 assume eight states "0 0 0" through "1 1 1" as indicated in Table 1 below, the eight scanning signals D1 through D8 are generated. The scanning signals D1 through D8 are assigned to key detection operations each for a half octave.

Table 1

| Contents of 3-bit counter 12 | Scanning signal | Assigned key switch note |
|---|---|---|
| 0 0 0 | D1 | $G_5$–$C_6$ |
| 0 0 1 | D2 | $C\#_5$–$F\#_5$ |
| 0 1 0 | D3 | $G_4$–$C_5$ |
| 0 1 1 | D4 | $C\#_4$ $F\#_4$ |
| 1 0 0 | D5 | $G_3$–$C_4$ |
| 1 0 1 | D6 | $C\#_3$–$F\#_3$ |
| 1 1 0 | D7 | $G_2$–$C_3$ |
| 1 1 1 | D8 | $C_2$,$C\#_2$–$F\#_2$ |

Thus, the 3-bit counter 12, the decoder 13, and the gate circuit 14 form a scanning signal generating circuit.

As is apparent from Table 1, output of the contents of the counter 12, the second and third bits represent an octave number which should be subjected to key detection, and the first bit represents which half octave is being subjected to key detection in one octave.

Thus, whenever the scanning signals D1 through D8 are sequentially and repeatedly applied to the key switch circuit 11 in the stated order, in the key switch circuit 11 it is detected whether or not a depressed key is included in each key switch group starting from the key switch group B8, and it is detected what number of a key switch (or key switches) has been depressed for each of the switch groups which are sequentially scanned and specified, thereby to output the key detection signals K1 and K2–K7. Thus, all the keys are, in time division manner, detected for depressed key state with a period which is determined from the period of the scanning signals D1 through D8. The key detection signals K1, K2–K7 applied to a preference circuit 16 through a 1-bit delay circuit 15 which gives the signals a delay corresponding to one clock pulse $\phi$.

In the preference circuit 16, a higher tone takes precedence over the others. Accordingly, a plurality of key detection signals (K1–K7) are applied to the circuit 16, only one key detection signal selected according to this priority order is delivered to a distribution circuit 17 connected thereto. The preference circuit 16 is as shown in FIG. 5, for instance.

Figure 5:
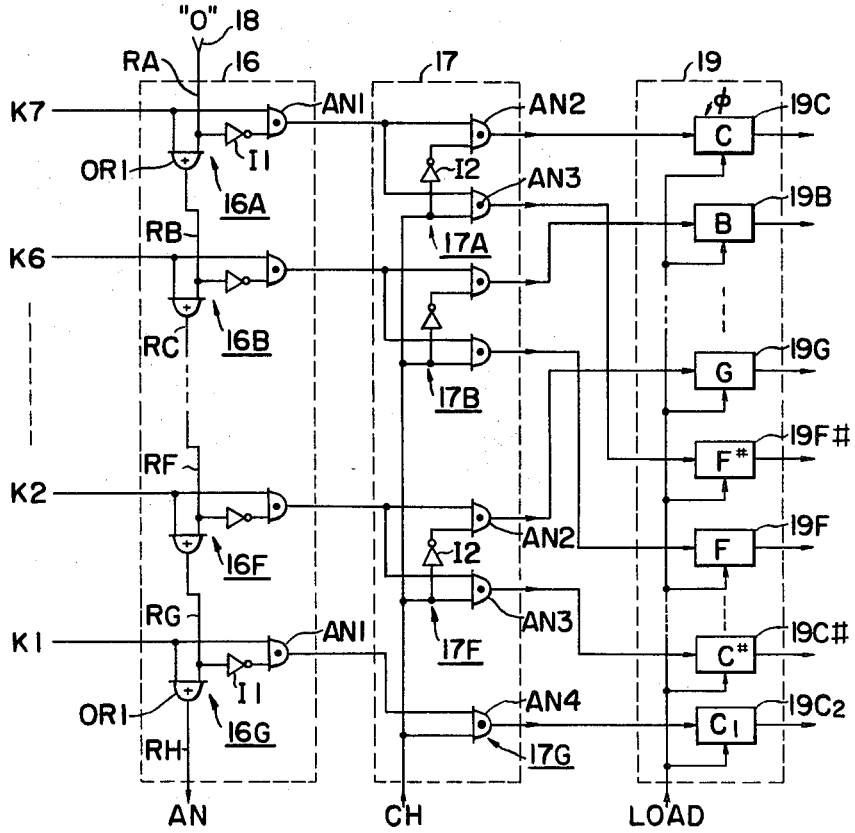
FIG. 5 through FIG. 7 are connection diagrams showing various elements in FIG. 2 in detail.

Referring to FIG. 5, the preference circuit 16 comprises gate circuits 16A through 16G which receive the key detection signals K7–K1 through the delay circuit 15, respectively.

The gate circuits 16A through 16G have AND gates AN1 which receive read condition signals RA through RG through inverters I1, respectively. When the read condition signals RA through RG are raised to a logic level "0" (hereinafter referred to merely as "0" for simplification, when applicable), the AND gates AN1 are opened and the key detection signals K1–K7 are delivered out, respectively.

The gate circuits 16A through 16G are provided with read condition signal generating OR gates OR1 which receive the key detection signals K7–K1 and the read condition signals RA–RG. The gate circuits 16A, 16B . . . 16G are allotted to tone ranges whose tone pitches increase in the stated order. In the gate circuits, the read condition signals RB, RC . . . RG provided by the gate circuits 16A through 16F assigned to higher tone ranges are received, and when the contents thereof are "0" (which means that no key switch has been depressed in the higher tone ranges) and the contents of the key detection signals K7, K6 . . . K1 are "0", the read condition signals RB, RC . . . RH for the gate circuits 16B through 16G assigned to lower tone ranges.

In this embodiment, as for the read condition signal RA to the gate circuit 16A assigned to the highest tone range, a signal source 18 at the logical level "0" is provided. The read condition signal RH outputted by the gate circuit 16G assigned to the lowest tone range provides an any-note signal AN (which means that "any" key switch is being depressed).

Thus, if key switches are turned on, in the preference circuit 16 only the key detection signal as to a tone having a first priority is delivered to the distribution circuit 17, for each of the key switch groups B8–B1.

In the distribution circuit 17, basing on which one of the first and second halves in one octave covers a key detection signal which is delivered thereto for every half octave, information on a note designated by the key detection signal is allowed to be stored in a memory circuit 19. The distribution circuit 17, as shown in FIG. 5, comprises switching circuits 17A through 17F and 17G which receive the outputs of the gate circuits 16A–16F and 16G in the preference circuit 16.

Each of the switching circuits 17A through 17F has a first AND gate AN2 which receives a switching signal CH as an open signal through an inverter I2, and a second AND gate AN3 which directly receives the switching signal CH. When the switching signal CH is at a logical level "0" (hereinafter referred to merely as "0" for simplification, when applicable), it is delivered out, as the high tone range selecting outputs of the switching circuits 17A through 17F, through the AND gates AN2. On the other hand, when the switching signal CH is at a logical level "1" (hereinafter referred to merely as "1" for simplification, when applicable), it is delivered out, as the low tone range selecting outputs of the switching circuits 17A through 17F, through the AND gates AN3.

The switching circuit 17G for the note $C_2$ is provided with a third gate AN4 whose operation is similar to that of the second gate AN3. When the switching signal is at "1", the output of the switching circuit 17G is delivered out of the gate AN4.

The switching signal CH is obtained by delaying the least significant bit output of the aforementioned 3-bit counter 12 by means of a 1-bit delay circuit 29 which gives a delay corresponding to one clock pulse $\phi$ to a signal applied thereto. Therefore, as is apparent from Table 1, when the switching signal CH is at "0", key detection is effected for the key switches which belong to the first half, higher tone range, of each octave. In contrast, when the switching signal CH is at "1", key detection is effected for the key switches which belong to the second half, lower tone range, of each octave.

The memory circuit 19 comprises: note memories 19$C_2$ through 19G for notes C through G which store the outputs of the switching circuits 17A through 17F of the distribution circuit 17 which are provided through the respective first gates AN2, as correspond to the first half, or higher tone range, of one octave; note memories 19F# through 19C# for notes F#-C# which store the outputs provided through the second gates AN3, as correspond to the second half, or lower tone range; and a note memory 19$C_2$ for note $C_2$ which stores the key detection signal of note $C_2$.

Each of the note memories 19$C_2$ and 19C#-19C may be a delay flip-flop circuit in which upon application of a load signal LOAD the write operation is carried out, and thereafter with the aid of a clock pulse firstly applied thereto the contents thereof are read out.

Thus, a key detection signal as to one tone which has been selected as highest in priority order by the preference circuit 16 is stored through the distribution circuit 17 in a note memory to which the corresponding note is assigned. The storage in this note memory is applied to a note D/A converter 20 and is superposed on the output of an octave D/A converter 21 (described later), and the resultant signal is supplied, as a tone pitch voltage signal KV, to the voltage controlled oscillator 1 by the key section 2 as was described with reference to FIG. 1 before.

Thus, the load signal LOAD is employed to cause one of the note memories in the note memory circuit 19 to store a note. This load signal LOAD is provided by a control logic circuit 22. After a note has been stored, the control logic circuit 22 operates to prevent the operation of storing the other notes.

Figure 6:
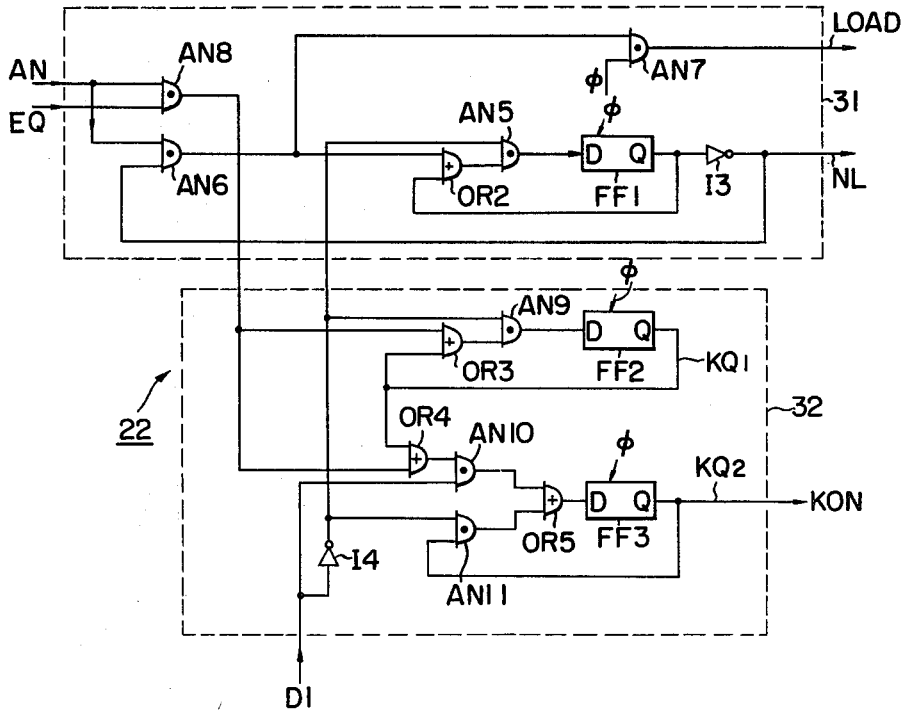

The control logic circuit 22 is as shown in FIG. 6. The control logic circuit 22 is provided with a scanning control circuit 31 comprising a delay flip-flop FF1 (which carries out the write-in operation upon application of the first lock pulse $\phi$ and the read-out operation upon application of the second clock pulse $\phi$ with an input signal applied thereto). When a logic "0" signal is stored therein, a scanning control signal NL at "0" is outputted through an inverter I3, whereupon the gate circuit 14 is opened to introduce the scanning signals D1 through D8 to the key switch circuit 11.

The scanning-control circuit 31 further comprises an AND gate AN5 which receives, as an open signal, the first scanning signal D1 of the decoder 13. When the first scanning signal D1 is not provided, the output of the flip-flop FF1 is fed back to its input terminal through an OR gate OR2 and the AND gate AN5, whereby the output is dynamically stored and maintained therein.

The storing operation of the scanning control circuit 31 is effected upon application of the any-note signal AN generated by the preference circuit 16. More specifically, the any note AN is written in the flip-flop FF1 through an AND gate AN6 which receives, as an open signal, the output "1" of the inverter I3, through the OR gate OR2, and through the AND gate AN5.

In this operation, the level of the scanning control signal NL is switched from "1" to "0", as a result of which the gate circuit 14 blocks the passage of the scanning signals D1 through D8.

As the level of the scanning control signal NL has been switched to "0", the AND gate AN6 is closed, thereby to inhibit the further application of the any note AN. However, the output of the flip-flop FF1 is maintained fed back through the OR gate OR2 and the AND gate AN5.

This state is reset when the first scanning signal D1 is generated to be applied through an inverter I4 to the AND gate AN5 thereby to close the latter.

The output of an AND gate AN6 is employed as the load signal LOAD. That is, the load signal LOAD is obtained by subjecting the output of the AND gate AN6 to waveform shaping by an output AND gate AN7 which is opened by the clock pulse $\phi$.

If, in the scanning control circuit 31 shown in FIG. 6, the flip-flop FF1 is not in memory state and the scanning control signal NL is at "1", and accordingly the key switch circuit 11 carries out the key detection scanning with the aid of the scanning signals D1 through D8 of the decoder 13, as a result of which the key detection signal highest in priority is applied to the preference circuit 16 whereby the any note signal AN is detected; then the output AND gate AN7 outputs the load signal LOAD, and therefore the key detection signal passed through the preference circuit 16 is stored in the corresponding note memory in the memory circuit 19 through the distribution circuit 17.

At the same time, the flip-flop FF1 is placed in memory state with the aid of the any note signal AN and the level of the scanning control signal NL is switched to "0", as a result of which the application of the scanning signals D1 through D8 of the decoder 13 to the key switch circuit 11 is prevented. Thus, the state of delivering the key detection signal highest in priority out of the preference circuit 16 is maintained.

The operated key's note detection system has been described as above. Detecting an octave to which this note belongs is carried out by the following octave detection system.

The output of two higher bits in the 3-bit counter 12 (indicating what octave relates to the present key detection) is applied, as an octave detection signal DOC, to an octave memory circuit 24 through a 1-bit delay circuit 23 which gives a signal a delay corresponding to one clock pulse $\phi$. Similarly as in the case of the above-described note memory circuit 19, upon application of the load signal LOAD from the control logic circuit 22, the memory circuit 24 stores the octave detection signal DOC which is presently applied to its input terminal through the delay circuit 23. The output of the memory circuit 24 is applied through a decoder 25 to the octave D/A converter 21, where it is converted into an analog data which is applied, as an addition input, to the note D/A converter 20.

Thus, the tone pitch voltage KV has the magnitude which is obtained by superposing an analog output having a value corresponding to an octave detected by the octave detection system on an analog output having a value corresponding to a note detected by the note detection system; that is, the tone pitch voltage KV has the magnitude corresponding to the tone pitch of a depressed key.

Figure 7:
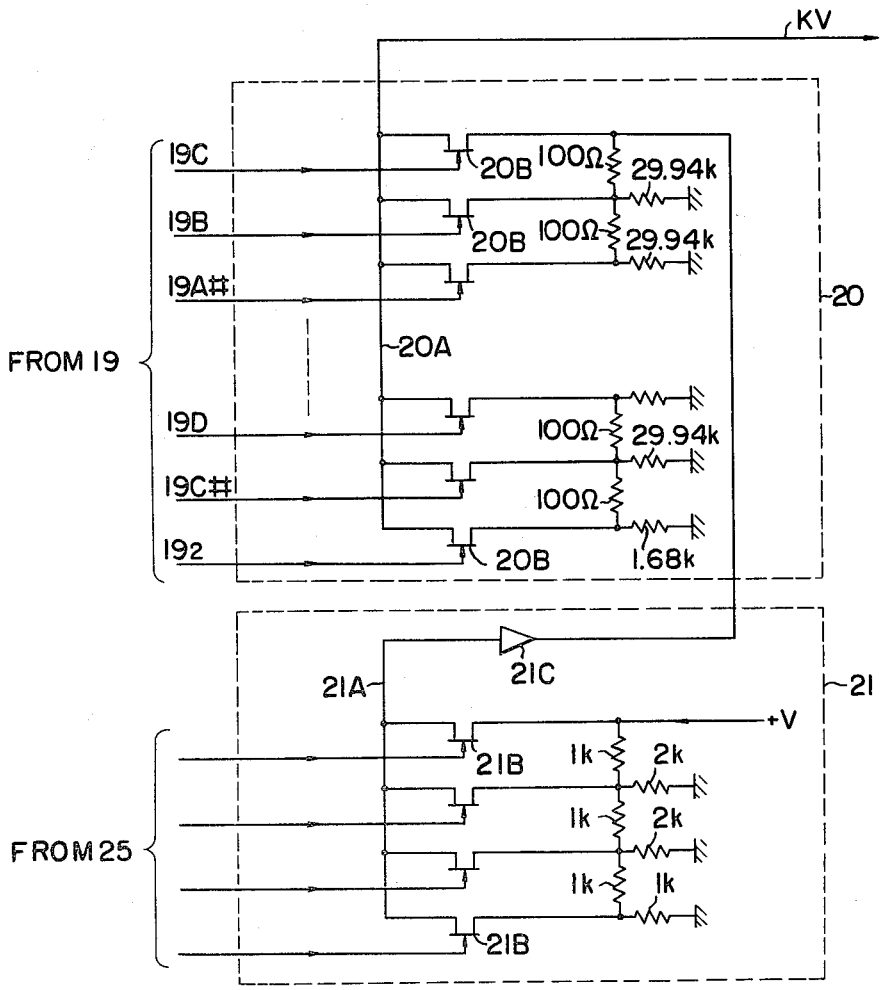

The note D/A converter 20 and the octave D/A converter 21 are as shown in FIG. 7.

The converters 20 and 21 comprise: voltage division circuits, namely, ladder-type resistor circuits obtained by connecting resistors in the form of a ladder; and switching transistors 20B and 21B adapted to introduce the outputs at the stages of the ladder-type resistor circuits to output lines 20A and 21A, respectively. A DC voltage +V is applied to one end terminal of the ladder-type resistor circuit in the octave D/A converter 21. The output line 21A is connected through a buffer circuit 21C to one end terminal of the ladder-type resistor circuit in the note D/A converter 20. The output line 20A of the note D/A converter 20 is employed as the output line of the key unit 2 (FIG. 1).

A control signal obtained by converting the output (consisting of code signals) of the octave memory circuit 24 by the decoder 25 is applied to the switching transistors 21B in the converter 21, whereby an analog output, having a relatively large level difference, corresponding to each octave is delivered out. The analog output is applied to the switching transistors 20B in the note D/A converter 20, to which the outputs of the note memories 19C-19C♯ and $19C_2$ in the note memory circuit 19 are applied as control signals. As a result, an analog output having relatively small level difference included in the level difference for one octave is outputted. Thus, as for the output analog value of the converter 20, an analog value which, in the octave to which a depressed key belongs, corresponds to a note assigned to the depressed key is delivered as the tone pitch voltage signal KV.

Figure 1:
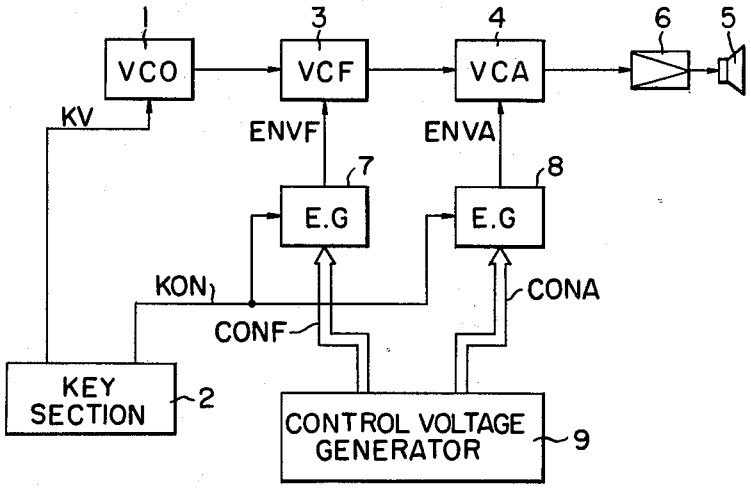
FIG. 1 is a block diagram showing an electronic musical instrument to which a single key preferential selection device according to this invention can be applied.

Thus, the tone pitch voltage signal KV corresponding to the tone pitch of a depressed key is outputted by the key section (FIG. 1).

The key-on detection signal KON which is applied, as a control signal, to the control waveform generating circuits 7 and 8 (FIG. 1) is generated as follows:

When a storing operation is effected by one of the note memories for one octave in the note memory circuit 19, its output is inversely converted into a key detection signal for a half octave by a selector which carries out switching operation with the aid of the distribution switching signal CH of the 3-bit counter 12, and the output thus converted is applied, as one comparison input, to a comparator 27. On the other hand, a key detection signal for a half octave of the priority circuit 16 is applied, as the other comparison input, to the comparator 27.

Similarly, when an octave code is stored in the octave memory circuit 24, its memory output is applied, as one comparison input, to the comparator 27, while the output of the delay circuit 23 is applied, as the other comparison input, to the comparator 27.

When coincidence is obtained with respect to the note memory and furthermore coincidence is obtained with respect to the octave memory, the comparator 27 supplies a coincidence detection signal EQ to the control logic circuit 22.

This coincidence detection signal EQ, as shown in FIG. 6, is applied through the input AND gate AN8 to the key-on detection signal forming circuit 32. The any note signal AN is applied to the AND gate AN8 to open the latter. When one of the key detection signals is applied to the priority circuit 16, the coincidence detection signal EQ is received through the AND gate AN8, so that it is taken in a front stage flip-flop FF2 through an OR gate OR3 and an input AND gate AN9. The resultant memory output KQ1 is dynamically stored through the OR gate OR3 and the AND gate AN9 in the FF2, but thereafter it is cleared with the aid of the scanning signal D1 supplied through the inverter I4.

On the other hand, the memory output KQ1 of the front stage flip-flop FF2 is applied through an input OR gate OR4, an AND gate AN10 and an OR gate OR5 to the input terminal of a rear stage flip-flop FF3, and it is written in the flip-flop FF3 when the AND gate AN10 is opened by the scanning signal D1 applied thereto. This memory output is dynamically stored therein through a feedback AND gate AN11, but it is thereafter cleared by the scanning signal D1 applied thereto through the inverter I4.

If, under this condition, a key operation is detected at the generation of one of the scanning signals D2 through D8 but before the arrival of the next scanning signal D1, a "1" signal from the AND gate AN8 is delivered into the front stage flip-flop FF2 at the generation of that scanning signal (meaning that a key belonging to the half octave corresponding to that signal has been operated). This storage is maintained until the next cycle scanning signal D1 is applied thereto.

Upon arrival of this next cycle scanning signal D1, the storage of the flip-flop FF2 is inputted into the rear stage flip-flop FF3 through the gate AN10 opened by the scanning signal D1. (In this operation, the storage of the flip-flop FF2 is once cleared by the scanning signal D1 supplied through the inverter I4, but it is stored again; that is, the flip-flop FF2 continuously carries out its storage operation.) If the key operation is being continuously carried out, then the front stage flip-flop FF2 carries out the storage operation again at the same scanning signal in the next cycle. Therefore, as soon as the rear stage flip-flop FF3 is cleared by the signal D1 applied through the inverter I4, the storage of the front stage flip-flop FF2 is inputted to the flip-flop FF3. That is, as long as the same key is depressed continuously, the rear stage flip-flop FF3 is maintained in storage stage, and the memory output KQ2 thereof is outputted as the key-on detection signal KON.

Figure 8A:
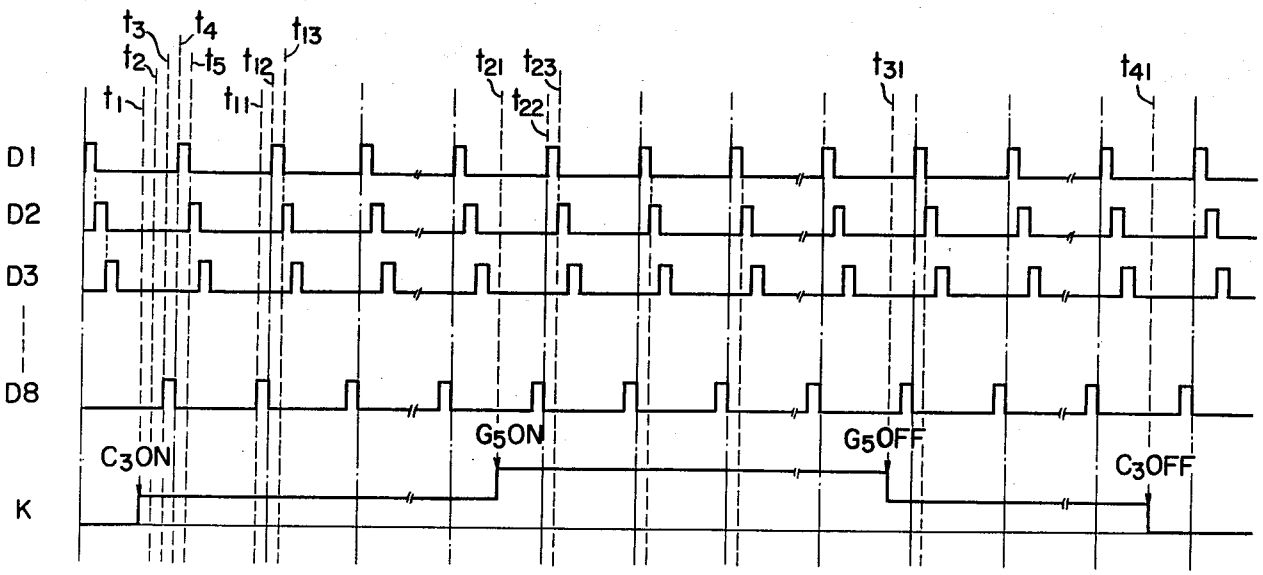
FIGS. 8*a* and 8*b* are signal waveform diagrams for a description of the circuit shown in FIG. 2.

The response operation of the circuitry organized as above will be described with respect to the following case, referring FIGS. 8*a* and 8*b*. In this case, first no key is operated, then the key $C_3$ belonging to the second key switch group B2 (FIG. 3) is depressed, next in addition to the key the key $G_5$ belonging to the eighth key switch group B8 is depressed, subsequently this key $G_5$ is released, and finally the key $C_3$ is released.

Before the time instant $t_1$ when the key $C_3$ is operated, the contents of the scanning control signal NL supplied by the scanning control circuit 31 (FIG. 6) in the control logic circuit 22 are "1", and therefore the scanning signals D1 through D8 from the decoder 13 are repeatedly applied to the key switch circuit 11. However, in this case, since closed key switches are available in none of the key switch groups B1 through B8, no any note signal AN is outputted by the priority circuit 16.

When the key $C_3$ is operated at the time instant $t_1$ (K in FIG. 8*a*), the operation is detected by the scanning signal D7 at the time instant $t_2$ when it is generated, and the key detection signal is applied through the priority circuit 16 to the distribution circuit 17 at the time instant $t_3$ one bit later, whereupon the any note AN is outputted (AN in FIG. 8*b*).

Figure 8B:
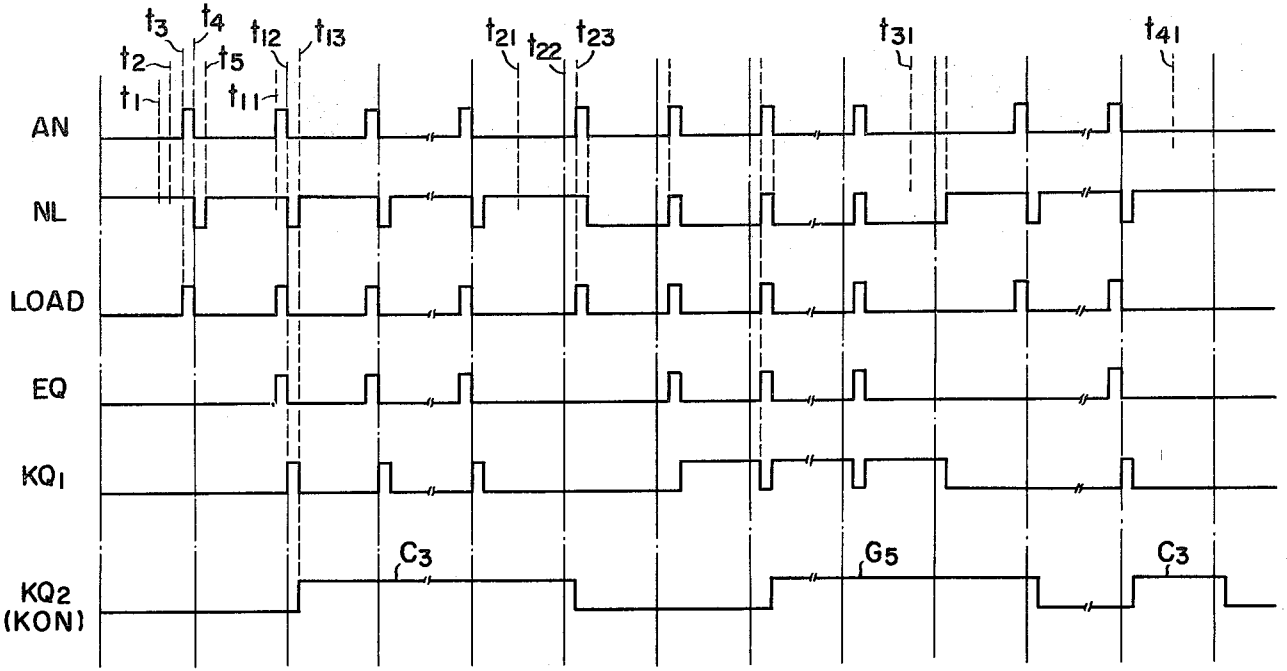

Upon arrival of the any note AN at the time instant $t_3$, the scanning control circuit 31 outputs the load signal LOAD under the condition that no storage operation is carried out by the flip-flop FF1 (LOAD in FIG. 8*b*). Accordingly, the key detection signal distributed by the distribution circuit 17 is written in the respective note memory 19C in the note memory circuit 19 with the aid of the load signal LOAD. In this case, the contents of the least significant bit in the 3-bit counter 12 are "1" corresponding to the scanning signal D8 (Table 1), while the contents of the distribution switching signal CH applied to the distribution circuit 17, being the output of the 1-bit delay circuit 29, become "0" corresponding to the scanning signal D7 one bit before. Therefore, the key detection signal applied to the switching circuit 17A in the distribution circuit 17 (FIG. 5) is stored in the note memory 19C through the AND gate AN2. This key detection signal thus stored is maintained unchanged until the load signal LOAD is applied.

On the other hand, the contents (Table 1) of the 3-bit counter 12 corresponding to the scanning signal D7 which is obtained through the 1-bit delay circuit 23 are inputted to the octave memory circuit 24. The contents thus inputted are maintained stored until the load signal LOAD is applied.

Thus, the output corresponding to the note C of the note memory circuit 19 is applied to the note D/A converter 20, and the output corresponding to the second octave of the octave memory circuit 24 is applied through the decoder 25 to the octave D/A converter 21. The outputs of these converters 20 and 21 are formed into the tone pitch voltage signal KV.

At the time instant $t_4$ one bit later than the time instant $t_3$, the flip-flop FF1 in the scanning control circuit 31 carries out memory-read-out-operation, as a result of which the contents of the control signal NL to the scanning signal gate circuit 14 are switched to "0" to suspend the delivery of the scanning signals D1 through D8 of the decoder 13. On the other hand, the control signal NL is applied to the AND gate AN6 to close the latter, as a result of which the load signal LOAD is not outputted before the flip-flop FF1 is reset.

The operation of the tone pitch voltage signal KV generating system is as described above.

On the other hand, the key-on detection signal KON is generated as follows:

By the generation of the load signal LOAD at the time instant $t_3$ (FIG. 8*b*), the comparison of the output of the note memory circuit 19 and the output of the priority circuit 16, and the comparison of the output of the octave memory circuit 24 and the output of the delay circuit 23 are carried out in the comparator 27. At this time instant, the contents of the memory circuits 19 and 24 is not read out yet. Therefore, no coincidence detection signal EQ is delivered (EQ in FIG. 8*b*), and accordingly none of the flip-flops FF2 and FF3 in the key-on detection signal forming circuit 32 carry out memory operation (KQ1 and KQ2 in FIG. 8*b*). When the contents of the memory circuits 19 and 24 are read out in one bit time thereafter, the outputs of the preference circuit 16 and the delay circuit 23 have been changed to those for the next step, and therefore no coincidence is obtained.

Accordingly, in the initial cycle in which memory operation is effected in the memory circuits 19 and 24, no coincidence detection signal EQ is outputted (EQ in FIG. 8*b*). Therefore, no memory operation is effected in the flip-flops FF2 and FF3 of the key-on detection signal forming circuit 32 in the control logic circuit 22 (KQ1 and KQ2 in FIG. 8*b*), and accordingly the key-on detection signal KON is not outputted.

Thereafter, the flip-flops FF1, FF2 and FF3 in the control logic circuit 22 are cleared by the scanning signal D1 which is provided by the decoder 13 at the time instant $t_4$. At the time instant $t_5$ one bit time later, the scanning control signal NL is raised to "1", as a result of which the gate circuit 14 is opened, and the next cycle key switch detection scanning is started for the switch circuit 11.

The operation of this cycle is similar to that of the initial cycle except that the memory circuits 19 and 24 have been placed in storing and reading state. In other words, as the key $C_3$ is still being depressed, the any note signal AN is an output by the preference circuit 16 with the timing of the scanning signal D8 at the time instant $t_{11}$, whereby the load signal LOAD is outputted by the control logic circuit 22. Thus, the contents newly inputted in the memory circuits 19 and 24 are the same as those which have been read out. Accordingly, the coincidence detection signal EQ (EQ in FIG. 8*b*) is provided by the comparator 27.

This coincidence detection signal EQ is written in the first flip-flop FF2 of the key-on detection signal forming circuit 32 through the gate AN8 at the time instant $t_{11}$, and is thereafter read out at the time instant $t_{12}$ one bit time later ($KQ_1$ in FIG. 8*b*).

The output $KQ_1$ of the flip-flop FF2 is written in the second flip-flop FF3 of the key-on detection signal forming circuit 32 through the gate AN10 with the aid of the scanning signal D1, and is thereafter read out at the time instant $t_{13}$ which is later than the time instant $t_{12}$ by one bit time ($KQ_2$ in FIG. 8*b*). The output $KQ_2$ thus read out is outputted as the key-on detection signal KON. Thus, the key-on detection signal KON is outputted with the timing of the scanning signal D2.

The contents of the flip-flops FF2 and FF3 are cleared by the next cycle scanning signal D1 applied through the gates AN9 and AN11, respectively. However, it should be noted that, with respect to the note $C_2$, the clearing operation by the gate AN11 and the writing operation by the gate AN10 are carried out in parallel for the flip-flop FF3. Accordingly, the key-on operation signal KON as indicated by "$KQ_2$" in FIG. 8*b* is continuously maintained in "on" state.

The second cycle operation as described above is repeatedly carried out as long as the key $C_3$ is maintained operated.

If, while the key $C_3$ is being depressed, the key $G_5$ is additionally depressed at the time instant $t_{21}$, the key switch detecting circuit 11 outputs, in the following cycles, the key detection signal with the aid of the scanning signal D1 at the time instant $t_{22}$ before the key $C_3$ is detected, and the any note signal AN is delivered by the preference circuit 16 at the time instant $t_{23}$ one bit time after.

As a result, the key detection signal of the key $C_4$ is written in the memory circuits 19 and 24 with the aid of the load signal LOAD, and the tone pitch voltage signal KV corresponding to the key $G_5$ is developed by the combination of the note D/A converter 20 and the octave D/A converter 21.

In this case, the outputs of the preference circuit 16 and the delay circuit 23 do not coincide with the read-out outputs of the memory circuits 19 and 24 (still storing the information on the key $C_3$). Accordingly, in the initial cycle as to the new key $G_5$, no coincidence detection signal EQ is delivered by the comparator 27 (EQ in FIG. 8*b*), and therefore the flip-flops FF2 and FF3 in the key-on detection signal forming circuit 32 do not carry out memory operation ($KQ_1$ and $KQ_2$ in FIG. 8*b*).

As is apparent from the waveform KON in FIG. 8*b*, the key-on detection signal KON is designed as follows: After the key-on detection signal KON is cleared by the scanning signal D1 at the time instant $t_{23}$, the flip-flop FF2 carries out writing operation with the timing of the scanning signal D2 firstly obtained after the generation of the coincidence signal EQ and reading operation with the timing of the scanning signal D3 ($KQ_1$ in FIG. 8*b*). Thereafter, according to the output $KQ_1$ the flip-flop FF3 carries out writing operation with the aid of the scanning signal D1 in the next cycle and reading operation the timing of the scanning signal D2. Thus, the key-on detection signal KON is not outputted at least for one cycle period of the scanning signals D1 through D8.

Thus, for the key $G_5$, the tone pitch voltage signal KV is outputted at the time instant one bit time later than the load signal LOAD delivery time instant $t_{23}$, and the key-on detection signal KON is outputted at the time instant two cycles later. This state is continued until the operation of the key $G_5$ is suspended.

When the key $G_5$ is released under this condition (with the key $C_3$ being depressed) at the time instant $t_{31}$, the key detection signal from the key switch 11 is switched to that which depends on the scanning signal D8. This new key detection signal is applied through the preference circuit 16 and the distribution circuit 17 to the note memory circuit 19 where it is stored and is then read out, while the octave code is written in the octave memory circuit 24.

Accordingly, where the provision of the coincidence detection signal (as to the key $G_5$) by the comparator 27 is suspended, the key-on detection signal forming circuit 32 operates in the same manner as described with reference to the case where the key $G_5$ is depressed at the time instant $t_{21}$. Accordingly, the key-on detection signal KON is not delivered for the period of at least one cycle, and thereafter the key-on detection signal KON as to the key $C_3$ is outputted with the aid of the scanning signal D2.

When the key $C_3$ is released at the time instant $t_{41}$ thereafter, similarly as in the case of the key $G_5$ released at the time instant $t_{31}$, delivering the tone pitch voltage signal KV and the key-on detection signal KON is suspended.

As is apparent from the above description, according to this invention the tone pitch signal and the key-on detection signal which are required to form a musical tone in a monophonic electronic musical instrument such as a monophonic music synthesizer can be readily provided by the single key preferential selection device capable of performing digital process.

In this connection, according to the invention, when a plurality of keys are depressed, the keys thus depressed are detected by scanning them in the predetermined order, so that when the key detection signal as to one key highest in priority is obtained, the further detection operation is suspended, as a result of which the generation of only a single tone can be positively effected.

Furthermore, in this invention, the key-on detection signal is formed according to the coincidence between the generation of tone pitch signal and the detection of a key highest in priority, and therefore the generation of the key-on detection signal occurs after the generation of the tone pitch signal at all times. That is, after the tone pitch signal becomes stable, the key-on detection signal is provided. Accordingly, generation of the tones can be made stable, and the erroneous operation attributed to the chattering of key switches can be prevented.

What is claimed is:

1. A single key preferential selection device in an electronic musical instrument comprising:

(a) a key switch circuit having input terminals, output terminals and a number of key switches connected between said input terminals and said output terminals in a matrix fashion, the input terminals defining a plurality of key switch groups, and the output terminals for delivering key detection signals in parallel via closed ones of said key switches;

(b) a scanning signal generating circuit for sequentially and repetitively applying scanning signals to said plurality of input terminals in a predetermined order, the repetition taking place at a period of scanning sequence, whereby said key detection signals are delivered when the scanning signal is being applied to the output terminal to which any closed key switches are connected;

(c) a preference circuit for selectively delivering out a single key detection signal of the highest priority from among key detection signals according to a predetermined priority order upon receipt of said key detection signals;

(d) a control circuit which, when said key detection signal is delivered from said preference circuit first time in each said period, inhibits the application of said scanning signals during a period from the delivery of said key detection signal to the end of each said period of scanning sequence; and (e) circuit means connected to said scanning signal generating circuit and to said control circuit for producing a group indication signal indicating the group at which said single key detection signal is delivered.

2. A single key preferential selection device according to claim 1, further comprising:

(f) a first memory circuit for storing said selected key detection signal from the preference circuit; and (g) a second memory circuit for storing said group indication signal.

3. A single key preferential selection device according to claim 2, further comprising:

(h) a comparator for comparing outputs of said memories with said key detection signal and said group indication signal to output a coincidence detection signal when the former and the latter coincide with each other; and (i) a circuit means for forming a key-on detection signal upon receipt of said coincidence detection signal.

* * * * *